US009128464B2

(12) United States Patent
Sarchi et al.

(10) Patent No.: US 9,128,464 B2
(45) Date of Patent: Sep. 8, 2015

(54) OSCILLATORS SYNCHRONISED BY AN INTERMITTENT ESCAPEMENT

(75) Inventors: Davide Sarchi, Renens (CH); Nakis Karapatis, Premier (CH); Thierry Hessler, St-Aubin (CH); Jean-Luc Helfer, Bienne (CH)

(73) Assignee: The Swatch Group Research and Development Ltd., Marin (CH)

( * ) Notice: Subject to any disclaimer, the term of this patent is extended or adjusted under 35 U.S.C. 154(b) by 25 days.

(21) Appl. No.: 13/610,024

(22) Filed: Sep. 11, 2012

(65) Prior Publication Data

US 2013/0070569 A1 Mar. 21, 2013

(30) Foreign Application Priority Data

Sep. 15, 2011 (EP) ..... 11181512

(51) Int. Cl.

| | |
|---|---|
| ***G04B 15/00*** | (2006.01) |
| ***G04B 17/00*** | (2006.01) |
| ***G04F 7/00*** | (2006.01) |
| ***G04B 17/20*** | (2006.01) |
| ***G04B 15/06*** | (2006.01) |
| ***G04B 17/06*** | (2006.01) |
| ***G04B 17/28*** | (2006.01) |
| ***G04F 7/08*** | (2006.01) |
| ***G04B 17/22*** | (2006.01) |
| ***G04B 17/26*** | (2006.01) |

(52) U.S. Cl.

CPC ..... *G04B 15/06* (2013.01); *G04B 15/00* (2013.01); *G04B 17/063* (2013.01); *G04B 17/20* (2013.01); *G04B 17/22* (2013.01); *G04B 17/26* (2013.01); *G04B 17/285* (2013.01); *G04F 7/08* (2013.01)

(58) Field of Classification Search

CPC ..... G04B 15/00; G04B 17/063; G04B 17/20; G04B 17/285

USPC ..... 368/101, 127, 169

See application file for complete search history.

(56) References Cited

U.S. PATENT DOCUMENTS

| | | | | |
|---|---|---|---|---|
| 1,232,285 | A * | 7/1917 | Greeley | 368/132 |
| 7,815,363 | B2 * | 10/2010 | Buttet et al. | 368/124 |
| 7,950,846 | B2 * | 5/2011 | Hessler et al. | 368/169 |
| 2002/0088295 | A1 * | 7/2002 | Oechslin | 74/437 |
| 2005/0007888 | A1 * | 1/2005 | Jolidon | 368/110 |

(Continued)

FOREIGN PATENT DOCUMENTS

| | | |
|---|---|---|
| CH | 156801 | 8/1932 |
| CH | 697523 B1 | 11/2008 |

(Continued)

OTHER PUBLICATIONS

U.S. Appl. No. 13/609,786, filed Sep. 11, 2012, Helfer, et al.

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A timepiece including a first resonator oscillating at a first frequency and connected by a main gear train to a main energy source via a main escapement, a second resonator oscillating at a second frequency which is lower than the first frequency and cooperating with the main escapement in order to synchronize maintenance of the first resonator to the second frequency.

12 Claims, 3 Drawing Sheets

(56) References Cited

U.S. PATENT DOCUMENTS

| | | | | |
|---|---|---|---|---|
| 2006/0221775 | A1* | 10/2006 | Zaugg | 368/127 |
| 2010/0002548 | A1 | 1/2010 | Hessler et al. | |
| 2010/0214879 | A1* | 8/2010 | Lechot et al. | 368/101 |

FOREIGN PATENT DOCUMENTS

| | | | |
|---|---|---|---|
| EP | 2 141 555 | A1 | 1/2010 |
| EP | 2 221 676 | A1 | 8/2010 |

OTHER PUBLICATIONS

U.S. Appl. No. 13/609,943, filed Sep. 11, 2012, Helfer, et al.

European Search Report issued Apr. 26, 2012 in corresponding European Application No. 11 18 1512 filed on Sep. 15, 2011 (with an English Translation).

* cited by examiner

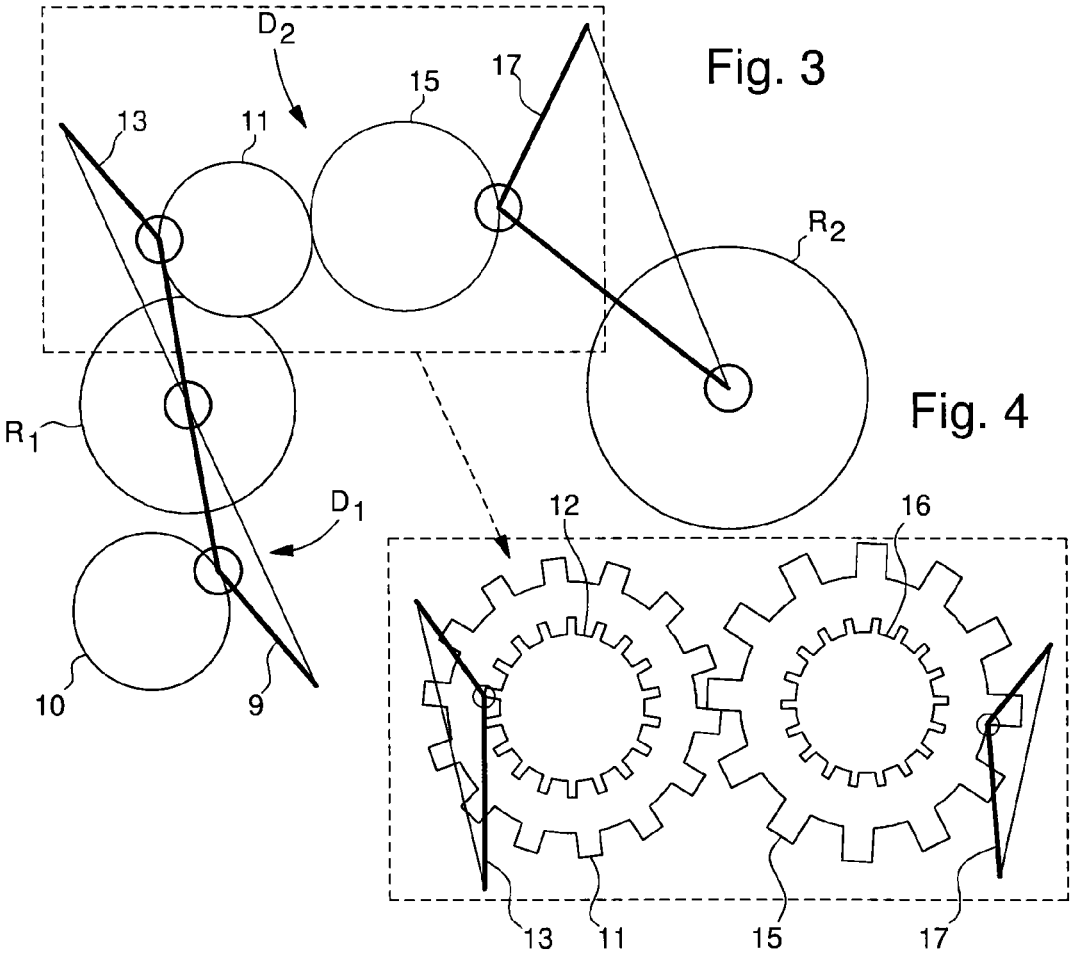
Fig. 3
Fig. 4
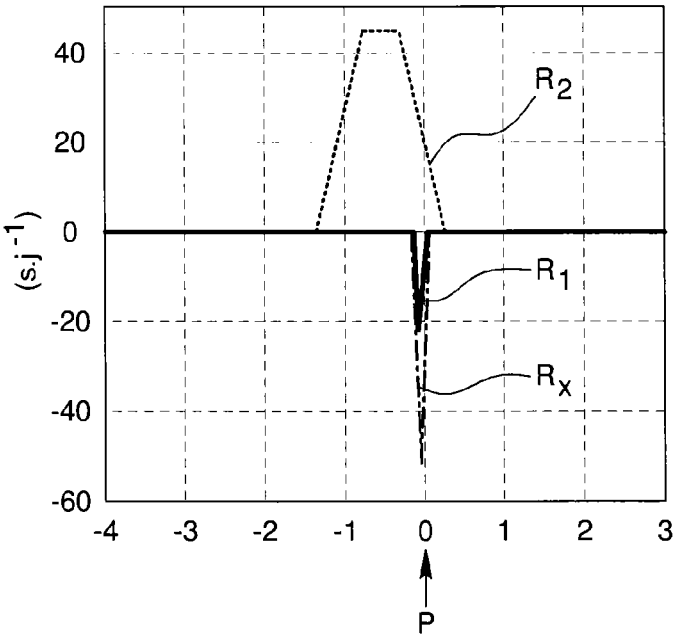
Fig. 7

OSCILLATORS SYNCHRONISED BY AN INTERMITTENT ESCAPEMENT

This application claims priority from European Patent Application No. 11181512.2 filed Sep. 15, 2011, the entire disclosure of which is incorporated herein by reference.

FIELD OF THE INVENTION

The invention relates to a timepiece comprising oscillators intermittently synchronised by an escapement.

BACKGROUND OF THE INVENTION

Generally, the regulating member of a watch is formed by a harmonic, damped, almost isochronous resonator, whose oscillation is maintained by an escapement system, which transfers the energy to the resonator at each oscillation vibration (lever escapement) or each oscillation period (detent escapement).

There are several problems concerning maintenance of the oscillation of the regulating member, also called the resonator. Thus, the transfer of energy to the resonator disturbs its frequency (and therefore the rate of the watch) in every case where the transfer is not symmetrical relative to the point of rest of the resonator. Further, the energy spent by the escapement per vibration (or per period) and the resonator frequency determine the power reserve of the watch, which is thus limited.

Moreover, since the amplitude of the oscillator is limited by geometrical reasons, in order to increase the energy of the oscillator (and therefore its stability against external disturbances) its elastic constant must be increased, which may mean that it is impossible to start up high frequency oscillators.

Finally, the mean efficiency of the escapement and fluctuations in efficiency are affected, amongst other things, by the acceleration of the escapement components. Thus, the more quickly the resonator recovers, the higher the efficiency and time constant will be. Hence, for very high frequency resonators, losses must necessarily be increased (and the power reserve decreased) and/or fluctuations in efficiency must be increased.

SUMMARY OF THE INVENTION

It is an object of the present invention to overcome all or part of the aforecited drawbacks by proposing a timepiece whose frequency (improved display resolution) and mechanical energy (improved stability and precision) are increased, and wherein the oscillation maintenance and power reserve are also improved.

The invention therefore relates to a timepiece comprising a first resonator oscillating at a first frequency and connected by a main gear train to a main energy source via a main escapement, a second resonator oscillating at a second frequency, which is a product of the first frequency according to a factor which is a rational number, characterized in that the second resonator also cooperates with the main escapement in order to release the main escapement to maintain the first resonator only when said second resonator oscillates.

It is clear that the invention enables the maintenance frequency of a resonator to be reduced below its frequency. The invention also ensures that a high frequency movement can auto-start while preserving its power reserve, particularly by improving the efficiency of the escapement functions.

Finally, the invention substantially reduces rate errors generated by disturbances outside the watch.

In accordance with other advantageous features of the invention:

- according to a first embodiment, the main escapement is a detent escapement and comprises a single escape wheel cooperating with a first detent spring controlled by the first resonator and a second detent controlled by the second resonator;
- according to a second embodiment, the main escapement is a detent escapement and comprises a first escape wheel cooperating with a first detent controlled by the first resonator and a second escape wheel cooperating with a second detent controlled by the second resonator, the first and second escape wheels being meshed with each other;
- according to a variant of the embodiments, the second resonator is also connected to a secondary gear train to a secondary energy source via a second escapement;
- the second escapement is a Swiss lever escapement;
- the variant includes a time display device comprising a display power source connected to a gear train for the display secured to a distribution mechanism formed by a detent and controlled by the main resonator or a time display device connected to the main gear train;
- according to a particular alternative of the variant, the timepiece includes a means of selectively locking the main escapement in order to measure a time using the first resonator by releasing said selective locking means;
- the particular alternative includes a device for displaying said measured time comprising a display energy source connected to a gear train for the display secured to a distribution mechanism controlled by the main resonator and a time display device connected to the secondary gear train.

BRIEF DESCRIPTION OF THE DRAWINGS

Other features and advantages will appear clearly from the following description, given by way of non-limiting illustration, with reference to the annexed drawings, in which:

FIG. 3 is a schematic diagram of the main escapement according to a second embodiment;

FIG. 4 is a partial enlarged diagram of FIG. 3;

FIGS. 6 and 7 are graphs showing the low shock dependence of a timepiece according to the invention following synchronisation of its resonators as regards their amplitude and rate variation respectively.

DETAILED DESCRIPTION OF PREFERRED EMBODIMENTS

As explained above, it is an object of the invention to integrate, in a mechanical wristwatch, a high frequency resonator (e.g. 10 Hz or 50 Hz or more) whose oscillation maintenance is synchronised by a low frequency resonator (e.g. 1 Hz or 2 Hz) in order to maintain the resonator over a period higher than its frequency.

Figure 1:
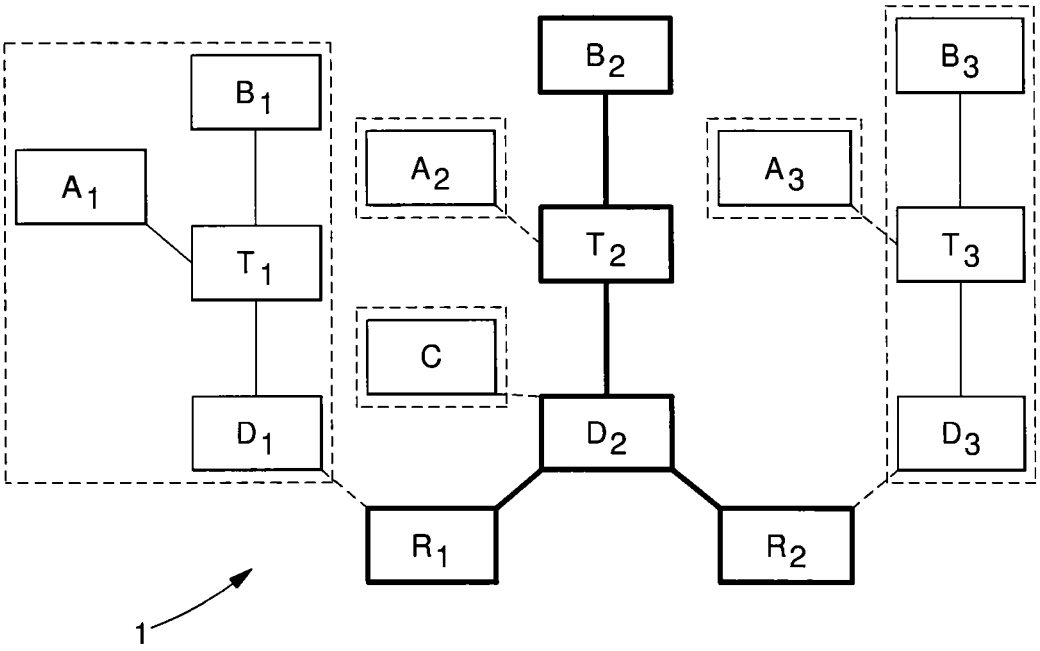
FIG. 1 is a schematic diagram of the elements of a timepiece according to the invention.

In an example embodiment illustrated in FIG. 1, timepiece 1 therefore includes a first resonator $R_1$ oscillating at a first frequency $f_1$ and connected by a main gear train $T_2$ to a main energy source $B_2$ via a main escapement $D_2$. Advantageously, timepiece 1 further comprises a second resonator $R_2$ oscillating at a second frequency $f_2$ which is lower than the first frequency and cooperating with the same main escapement $D_2$ in order to synchronise maintenance of the first resonator $R_1$ to said second frequency $f_2$.

Preferably, according to the invention, the second frequency $f_2$ is a fraction of the first frequency ($f_2=f_1/N$ or $f_2=f_1/2N$ where N is an integer number greater than 1). It is thus clear that main resonator $R_1$ is maintained solely with the period of the secondary resonator.

However, the factor may also be a rational number N' if the gear ratio $R_i$ is different between each oscillator. Indeed, in this variant, the frequencies on the wheel which secures the two escapements must be linked by a multiple integer number. However, the gear ratio can arbitrarily and independently subdivide the frequency of the oscillators. The oscillator frequencies may then not be linked by an integer number, but by a rational number ($f_2=f_1/N'$ where N' is equal to $N*R_1/R_2$ where N is an integer number greater than 1).

This configuration advantageously means that a basic movement (or chronograph movement) can be made with a high resolution (for example 1/20th of a second or 1/100th of a second). It also increases the precision and shock resistance of the main resonator and increases the power reserve while guaranteeing that even a very high frequency movement, for example 50 Hz, can auto-start. Finally, this configuration allows low amplitude resonators to be maintained and the display train and/or maintenance train to be partially or totally omitted.

Figure 2:
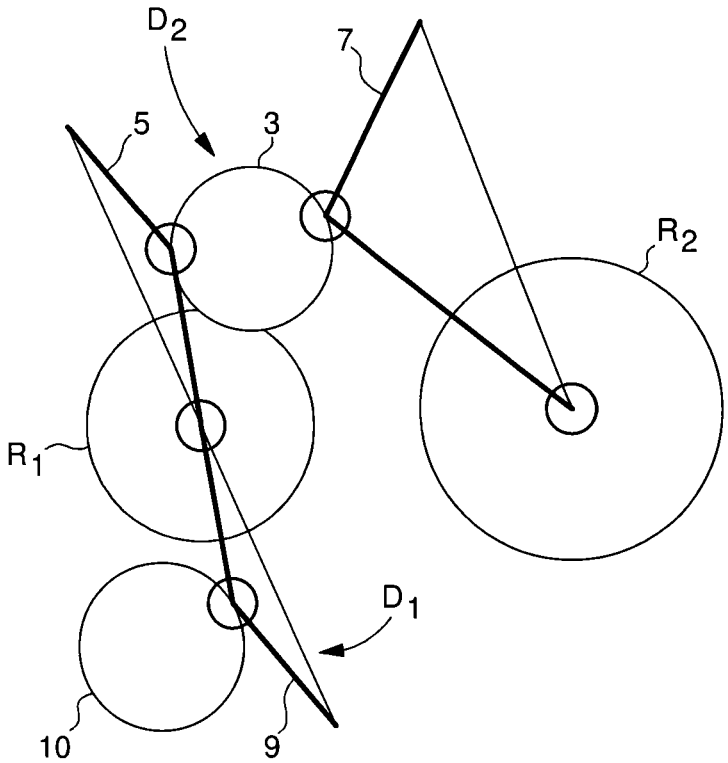
FIG. 2 is a schematic diagram of the main escapement according to a first embodiment.

According to a first embodiment illustrated in FIG. 2, main escapement $D_2$ is a detent escapement and comprises a single escape wheel 3 cooperating with a first detent 5, controlled by first resonator $R_1$ and a second detent 7 controlled by the second resonator $R_2$.

By way of example, it can be assumed that wheel 3 is free if the two resonators $R_1$ and $R_2$ are situated around the point of rest in the angular interval (−20°, +20°). To ensure that the main resonator $R_1$ is maintained, if the two resonators have a considerably different phase, i.e. they pass the point of rest at two different moments, detent 7 of secondary resonator $R_2$ may be devised to increase the angular interval in which main escapement $D_2$ is released by secondary resonator $R_2$. It is thus clear that detent 7 of secondary resonator $R_2$ preferably includes release over a larger angular interval than the angle of detent 5 at which main resonator $R_1$ releases wheel 3.

Consequently, as soon as the detent is released, since the braking force acting on the oscillator is applied very close to the centre of rotation of the oscillator, the resulting perturbation torque is very low, i.e. the angle of release for secondary resonator $R_2$ may thus be considerably increased without affecting the rate.

If, after a shock, the phase difference of the resonators is too great and oscillation cannot be maintained, it is clear that the increasing or decreasing isochronism curve of main resonator $R_1$ allows the phase to be made up between the two resonators after a few oscillations. In fact, main resonator $R_1$ will lose amplitude until phasing is re-established between the oscillation of secondary resonator $R_2$ and one of the N oscillations of main resonator $R_1$. It is thus clear that the additional rate error on the display will be less than or equal to one period of main resonator $R_1$, which means that it will become smaller the higher the frequency $f_1$ becomes.

According to a second embodiment illustrated in FIGS. 3 and 4, main escapement $D_2$ is a detent escapement and comprises a first escape wheel 11 cooperating with a first detent 13 controlled by the first resonator $R_1$ and a second escape wheel 15 cooperating with a second detent 17 controlled by the second resonator $R_2$, the first and second escape wheels 11, 15 being meshed with each other. It is thus clear that, structurally, the same advantages are obtained as for the first embodiment, particularly during intrinsic or shock-induced phase differences.

However, compared to the first embodiment, it is noted that resonators $R_1$ and $R_2$ release, by detent, two different wheels 11 and 15, which mesh (in parallel or in series) with the main gear train $T_2$. Once released, wheel 15 is not locked again until wheel 11, and therefore escapement $D_2$, is released. In this case, escapement $D_2$ is released at each oscillation period (or vibration) of main resonator $R_1$ and at each oscillation of secondary resonator $R_2$, maintenance is guaranteed independently of the phase difference of resonators $R_1$ and $R_2$.

The example illustrated in FIG. 4 shows the meshing of wheels 11, 12, 15, 16 and detents 13, 17. Escape wheel 15 is released by detent 17 at top toothing 16 on each oscillation of secondary resonator $R_2$ and describes a small angle before being locked again by top toothing 16 via detent spring 17 of secondary resonator $R_2$. However, during the motion of wheel 15, wheel 11 remains locked on top toothing 12 by detent 13 of main resonator $R_1$.

When main resonator $R_1$ passes, wheel 11 is released by detent 13 at top toothing 12 and allows main resonator $R_1$ to be maintained, before being locked again by detent spring 13 on top toothing 12 and/or by wheel 15 which then plays a part comparable to a stopping device. Of course, wheel 11 remains locked when main resonator $R_1$ passes if secondary resonator $R_2$ has not previously released wheel 15.

It is thus clear that the two embodiments of main escapement $D_2$ provide substantially the same advantages and use a single main escapement $D_2$ for the two resonators $R_1$ and $R_2$, i.e. the resonators are maintained using the same main energy source $B_2$ by main escapement $D_2$.

According to a variant of the above two embodiments, the second resonator $R_2$ is also connected to a secondary gear train $T_3$ to a secondary energy source $B_3$ via a second escapement $D_3$. Indeed, if it becomes necessary to maintain secondary resonator $R_2$ outside main escapement $D_2$, a second escapement $D_3$ preferably a Swiss lever escapement, maintains secondary resonator $R_2$. Thus, at each vibration of secondary resonator $R_2$, the latter is powered by secondary energy source $B_3$ (or, alternatively, by the main energy source $B_2$ by means of a gear) via the secondary gear train $T_3$.

A particular alternative of this variant which requires maintaining secondary resonator $R_2$ outside main escapement $D_2$ is shown in FIG. 1. In this alternative, timepiece 1 includes a means C of selectively locking main escapement $D_2$ in order to measure a time using first resonator $R_1$ by releasing said selective locking means. It is thus clear that, structurally, main resonator $R_1$ becomes a chronograph device, i.e. it only operates during measuring periods and secondary resonator $R_2$ is the basic movement, i.e. it is permanently in operation. Of course, in this alternative, the secondary resonator $R_2$ preferably has good isochronism to allow proper display after the release of said selective locking means C.

The advantages of the invention have been quantified from the variant of the first embodiment of main escapement $D_2$. If the elastic constant of the resonator is $k_j$ and its inertia $m_j$ its oscillation frequency is:

$$f_j=\sqrt{k_j}/m_j/2\pi \quad (1)$$

For a stationary amplitude $A_j$, the mechanical energy of the resonator j is:

$$E_j=\tfrac{1}{2}k_jA_j^2 \quad (2)$$

The resonator energy loss j at each oscillation is:

$$\Delta E_j = \frac{\pi E_j}{2Q_j} \tag{3}$$

and depends on the resonator quality factor $Q_j$ (which, for viscous friction, increases with frequency).

The escapement must supply the same quantity of energy. If the torque applied to the resonator is constant over a given angle $\theta_j$, the maintenance energy is:

$$E_{ech} = C_{ech}\theta_j = \Delta E_j = \frac{\pi E_j}{2Q_j} \tag{4}$$

Increasing the resonator frequency increases the quality factor $Q_j$, which promotes improved timing. If the resonator energy is constant, losses decrease and the maintenance energy also decreases. Since the angle of energy transmission cannot be decreased indefinitely, the maintenance torque must be decreased.

Moreover, the condition necessary for starting is that the maintenance torque exceeds the elastic return torque of the resonator at the exit angle thereof.

$$C_{ech} > k_j\theta_j/2 \tag{5}$$

This means that the maintenance torque cannot be decreased indefinitely while maintaining the auto-start property of the resonator, and, at the same time, without decreasing the mechanical energy of the resonator which decreases its stability against external disturbance.

It must also be realised that the increase in frequency and decrease in maintenance torque results in a higher resonator speed ($v=2\pi f A$, (6)) at the point of rest, i.e. at the moment when maintenance does not cause rate errors, while the acceleration of the escape wheel sets is lower. It is thus observed that the escapement efficiency drops because the escapement is unable to catch up with the resonator. It is thus clear that the escape wheel sets must catch up with the resonator speed during the time available for maintenance:

$$C_{ech}/m_{ech} > v/dt_{ech} = v^2/\theta_j \tag{7}$$

where $m_{ech}$ is the equivalent inertia of the escapement.

Finally, if the frequency and energy of the resonator are increased, the power reserve will necessarily decrease, since the escapement must maintain the resonator more often and with more energy each time.

Thus, quantitatively, for an ordinary resonator with a frequency f equal to 10 Hz, an inertia m equal to 2 mg·cm$^2$, an elastic coefficient k equal to 0.79 μNm·rad$^{-1}$ and a quality factor Q equal to 600, the maintenance energy $E_{ech}$ is substantially equal to 25 nJ. According to relation (4), therefore, maintenance torque $C_{ech}$ is substantially equal to 28 nNm, for a maintenance angle $\theta_j$ of 50°. The system does not auto-start because the term $k\cdot\theta_j/2$ is greater than the maintenance torque $E_{ech}$ according to relation (5).

On the other hand, the time available for maintenance, which corresponds to the resonator passing from the point of rest, is reduced to $dt_{ech}$ equal to 40°, i.e., according to relation (6), a time of 2.3 milliseconds for an amplitude A equal to 280°. To achieve sufficient acceleration of the escape wheel sets with such a low maintenance torque, according to relation (7), the inertia of the maintenance wheel sets has to be considerably reduced to an equivalent inertia of substantially $2.10^{-3}$ mg·cm$^2$.

If a resonator of the same type is maintained by an escapement $D_2$ according to the invention, at a frequency $f_2$ equal to 1 Hz, the lost energy to be compensated for at each maintenance function is 20 times higher. At parity, with a maintenance angle $\theta_j$ equal to 50°, the maintenance torque $C_{ech}$ is 20 times higher, i.e. approximately 0.7 μNm, and the self-start system accords with relation (5).

Likewise, the acceleration of the maintenance wheel sets is increased 20 fold and efficiency can be freely optimised, the only constraint being geometrical and tribological and no longer dynamic and related to the energy balance. Consequently, since efficiency is improved, the power reserve is necessarily improved.

To demonstrate the advantages of the timepiece of the invention, the coupled movement equations were resolved numerically. A secondary resonator $R_2$ with an inertia $m_2$ equal to 10 mg·cm$^2$, a frequency $f_2$ equal à 1 Hz and a quality factor $Q_2$ equal to 150 was considered. Moreover, the main resonator $R_1$ has a mechanical energy equal to 9.6 μJ, whereas secondary resonator $R_2$ has an energy equal to 0.5 μJ.

Figure 5:
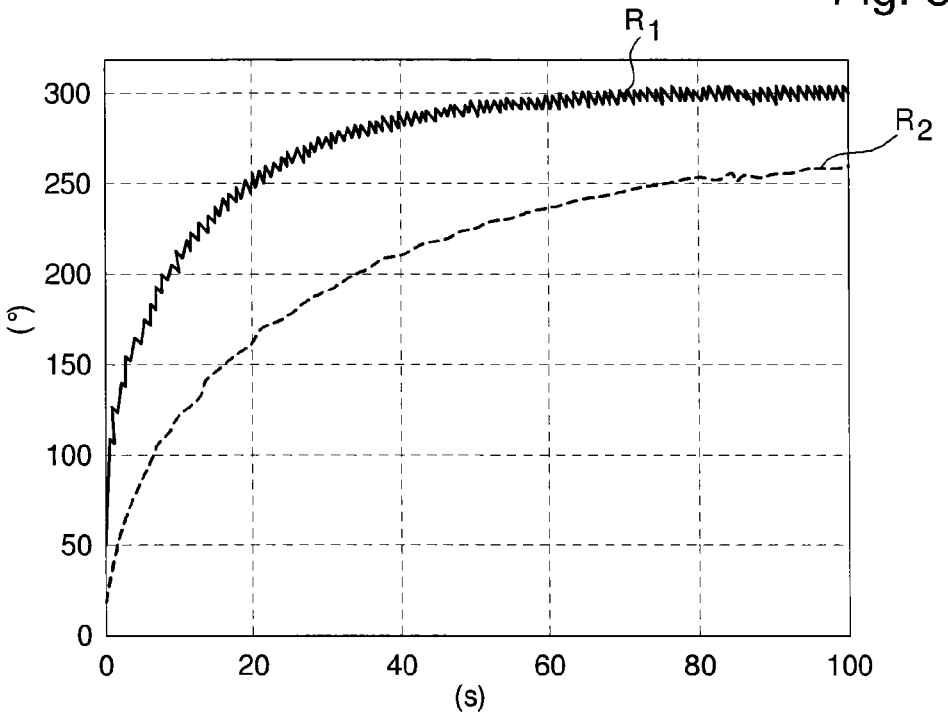
FIG. 5 is a graph showing the synchronisation of the resonators according to the invention.

FIG. 5 shows a simulation of the starting of the two resonators $R_1$ and $R_2$. The main high frequency resonator $R_1$ returns to its stationary frequency after approximately 50 seconds. It is noted that low frequency secondary resonator $R_2$ returns to its stationary amplitude more slowly. However, this has no significant effect since the function of regulating the transfer of energy to main resonator $R_1$ is fully operational as soon as secondary resonator $R_2$ recovers several tens of degrees. Consequently, the timepiece succeeds in auto-starting and is stabilised on a substantially stationary amplitude for main resonator $R_1$ even if it is equal to or higher than 10 Hz.

Figure 6:
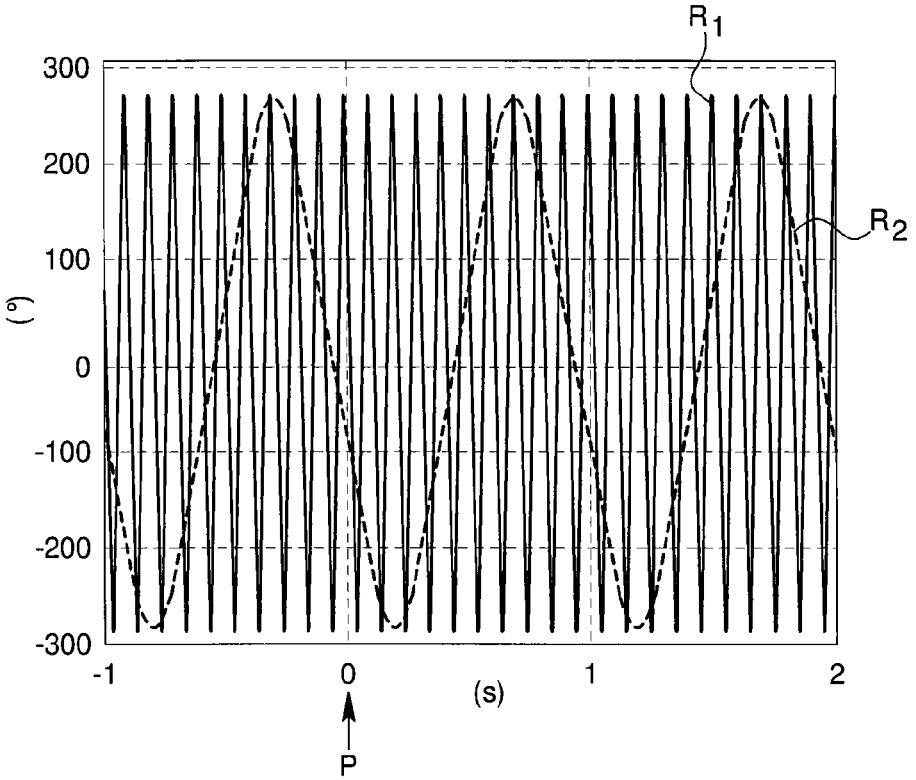

FIG. 6 shows a simulation of the disturbance P made to the timepiece when the two resonators $R_1$ and $R_2$ are stabilised. Disturbance P, equal to 0.1 μJ, occurs at moment t=0 by an impulsed angular acceleration of 50 rad·s$^{-2}$ with a Gaussian shape and a width of 20 milliseconds. It is to be noted that resonators $R_1$ and $R_2$ do not experience any significant phase difference prior to and after disturbance P.

Moreover, FIG. 7 shows a simulation of the same disturbance P made to the timepiece when the two resonators $R_1$ and $R_2$ are stabilised. This time, it is the rate of each resonator that is measured relative to that of a single resonator $R_x$. It can be seen that the presence of an escapement $D_2$ according to the invention does not amplify the rate error compared to the single resonator $R_x$. It is therefore clear that the direct effect on main resonator $R_1$ and the indirect effect of maintaining main resonator $R_1$ on resonator $R_2$ partially compensate for each other.

Consequently, the response of a timepiece according to the invention to a given disturbance P is similar, or even better than the response of an equivalent single resonator $R_x$, i.e. with the same energy $E_x$, same frequency $f_x$ et same amplitude $A_x$. Further, secondary resonator $R_2$ advantageously forms an anti-tripping system for the maintenance function, particularly by preventing rate errors linked to dual maintenance.

Depending upon the embodiment, variant and/or alternative selected above, timepiece 1 according to the invention proposes three types of display device $A_1$, $A_2$ and/or $A_3$.

A first display type includes a display device $A_1$ comprising a display energy source $B_1$ connected to a gear train for the display $T_1$ secured to a distribution mechanism $D_1$ controlled by main resonator $R_1$. Preferably according to the invention, the distribution mechanism $D_1$ is formed by a detent 9 controlled by main resonator $R_1$ so as to release, at each period or vibration of main resonator $R_1$, wheel 10 connected to gear train $T_1$ without providing any additional maintenance torque to first resonator $R_1$.

It is thus clear that display device $A_1$ takes advantage of the high frequency of main resonator $R_1$ by displaying the movement, for example of wheel 10, i.e. with improved resolution such as, for example, up to 1/20th of a second or up to 1/100th of a second. Consequently, in the case of the two embodiments and/or the variant explained above, display device $A_1$ can display the time with improved resolution. Further, in the case of the alternative explained above, display device $A_1$ can display the measured time with improved resolution.

A second display type includes a time display device $A_2$ connected to secondary gear train $T_2$. It is therefore clear that the display occurs at the same time that main resonator $R_1$ is being maintained. In this case, the high frequency is not used to improve resolution but to improve stability. It is also clear that this configuration forms a very efficient anti-tripping system for detent escapement $D_2$, regardless of the embodiment used.

Finally, a third display type includes a time display device $A_3$ connected to secondary gear train $T_3$. This third type is entirely dedicated to the above alternative in which main resonator $R_1$ is used solely for measuring a time. Indeed, since secondary resonator $R_2$ is the only one permanently operating, the time display can only be performed using secondary gear train $T_3$.

In light of the above explanations, it is clear that the invention reduces the maintenance frequency of a resonator to below its frequency. The invention also ensures that a high frequency movement can auto-start while preserving its power reserve, particularly by improving the efficiency of the escapement functions. Finally, the invention substantially reduces rate errors generated by disturbances outside the watch.

Of course, this invention is not limited to the illustrated example but is capable of various variants and alterations that will appear to those skilled in the art. In particular, other types of resonators and/or escapements can be envisaged without departing from the scope of the invention. By way of example, some mechanical components could advantageously be replaced and/or assisted by magnetic components.

Finally, the timepiece may comprise a single energy source, i.e. a single energy source fitted with gears may respectively form the energy sources $B_1$ and/or $B_2$ and/or $B_3$ described above.

What is claimed is:

1. A timepiece comprising:

a first resonator oscillating at a first frequency and connected by a main gear train to a main energy source via a main escapement, a second resonator oscillating at a second frequency lower than the first frequency, and the second frequency is a product of the first frequency according to a factor which is a rational number, wherein the second resonator also cooperates with the main escapement to release the main escapement in order to maintain the first resonator only when said second resonator oscillates so as to maintain the first resonator over a period higher than that of said first frequency.

2. The timepiece according to claim 1, wherein the main escapement is a detent escapement and comprises a single escape wheel cooperating with a first detent, controlled by first resonator and a second detent controlled by the second resonator.

3. The timepiece according to claim 1, wherein the main escapement is a detent escapement and comprises a first escape wheel cooperating with a first detent controlled by the first resonator and a second escape wheel cooperating with a second detent controlled by the second resonator, the first and second escape wheels being meshed with each other.

4. The timepiece according to claim 1, wherein the second resonator is also connected by a secondary gear train to a secondary energy source via a second escapement.

5. The timepiece according to claim 4, wherein the second escapement is a Swiss lever escapement.

6. The timepiece according to claim 4, wherein it includes a means of selectively locking the main escapement in order to measure a time using the first resonator by releasing said selective locking means.

7. The timepiece according to claim 6, wherein it includes a device for displaying said measured time, comprising a display energy source connected to a gear train for the display secured to a distribution mechanism controlled by the first resonator.

8. The timepiece according to claim 6, wherein it includes a time display device connected to the secondary gear train.

9. The timepiece according to claim 1, wherein it includes a time display device comprising a display energy source connected to a gear train for the display secured to a distribution mechanism formed by a detent controlled by the first resonator.

10. The timepiece according to claim 1, wherein it includes a time display device connected to the main gear train.

11. The timepiece according to claim 1, wherein it includes a single energy source.

12. The timepiece according to claim 1, wherein a maintenance frequency of said first resonator is synchronized by said second frequency.

* * * * *